United States Patent [19]

Ujihara

[11] Patent Number: 4,644,694

[45] Date of Patent: Feb. 24, 1987

[54] WINDING DEVICE FOR CABLES

[75] Inventor: Hiroshi Ujihara, Yokohama, Japan

[73] Assignee: Ohi Seisakusho Co., Ltd., Kanagawa, Japan

[21] Appl. No.: 763,803

[22] Filed: Aug. 8, 1985

[30] Foreign Application Priority Data

Aug. 15, 1984 [JP] Japan ..... 59-124044[U]

[51] Int. Cl.[4] ..... E05F 11/48

[52] U.S. Cl. ..... 49/352; 242/117; 254/374

[58] Field of Search ..... 242/117, 157.1; 254/374; 49/352

[56] References Cited

U.S. PATENT DOCUMENTS 2,793,740 5/1957 Daudt ..... 254/374 X 4,534,233 8/1985 Hamaguchi ..... 49/352 X

FOREIGN PATENT DOCUMENTS 2087973 6/1982 United Kingdom ..... 49/352

*Primary Examiner*—Kenneth Downey

*Attorney, Agent, or Firm*—Rosen, Dainow & Jacobs

[57] ABSTRACT

A winding device for cables which is used to wind cables round take-up drums along grooves provided on the outer circumferences thereof, said grooves formed such that the cables will not cause chafing against the side walls of the grooves, so that no unusual noise is caused or the cables will not be worn severely during operation. This winding device can be applied to a window regulator for automobiles.

8 Claims, 6 Drawing Figures

WINDING DEVICE FOR CABLES

BACKGROUND OF THE INVENTION

The present invention relates to a winding device for cables, particularly to a configuration of grooves formed in the outer circumference of a take-up drum for guiding cables to be wound round the take-up drum.

In an automobile window regulator of the wire driving type, for example, such a winding device for cables as shown in FIGS. 1 and 2 has been used for winding cables such as steel wires.

This winding device is provided with a cylindrical take-up drum 55 which rotates in combination with a rotary shaft 54 rotatable in either direction by means of an operating handle or a driving motor (both not shown in the drawings), said take-up drum being mounted within a support 53 comprising a box-shaped casing 51 which has an opening facing downwardly in the drawing and a base plate 52 which closes the opening of the casing 51. The upper and lower portions of the outer circumference of the take-up drum 55 are provided with grooves 56, 57, said grooves having a V-shaped or U-shaped cross-section and formed in spiral in the same direction, in which cables 60, 61, such as wires, are drawn from openings 58*a*, 59*a* formed at each end of a pair of guide tubes 58, 59. The openings 58*a*, 59*a* face take-up drum 55, said guide tubes being secured to one end part of the casing 51, and the cables 60, 61 are wound round the outer circumference of the take-up drum 55 along said grooves 56, 57 in opposite directions to each other.

The numerical references 62, 63 designate bores for leading each end of the cables 60, 61 respectively into the inside of the take-up drum 55 and fastening them therein.

In such a conventional winding device for cables as mentioned above, as clearly illustrated in FIG. 2, since the groove 57 for guiding the cable is formed in the outer circumference of the take-up drum 55 such that angles $\theta_1,\theta_2$ between each side wall 57*a*, 57*b* and a normal line H perpendicular to the rotational axis of the take-up drum 55 are always substantially equal ($\theta_1=\theta_2$), there are problems in winding the cable 61 round the take-up drum 55 at a certain point O located far from the opening 59*a* as shown in FIG. 1. The problems include chafing of the cable 61 against the side wall 57*a* of the groove 57 and on the side of the opening 59*a* which may cause unusual noise and/or the cable and the side wall to be worn severely.

The groove 56 also suffers the same problems as with the groove 57, though not shown in the drawings, because it is constructed symmetrical in relation to the groove 57.

As a solution to the above mentioned problem, it is considered to increase the angle $\theta_1+\theta_2$ between each side wall 57*a*, 57*b* of the groove 57. However, with this arrangement, pitch P of the groove 57 would become large and the length of the take-up drum 55 must be made longer, so that there would be other problems such that the entire body of the device becomes too large in size.

SUMMARY OF THE INVENTION

An object of the present invention is to provide a winding device for cables which can completely solve such problems as mentioned above.

Another object of the invention is to provide a window regulator for automobiles using said novel winding device for cables.

According to the present invention, in order to solve the forementioned problems, there is provided a winding device for cables wherein grooves having a substantially V-shaped or U-shaped cross-section are formed in the outer circumference of a take-up drum rotatably mounted to a support, and cables drawn from openings provided on said support are wound round the outer circumference of the take-up drum along said grooves, characterized in that the angles between side walls of said grooves on the side of said openings and normal lines perpendicular to the rotating axis of the take-up drum increase gradually with distance from the openings.

DESCRIPTION OF THE PREFERRED EMBODIMENTS

Figure 3:
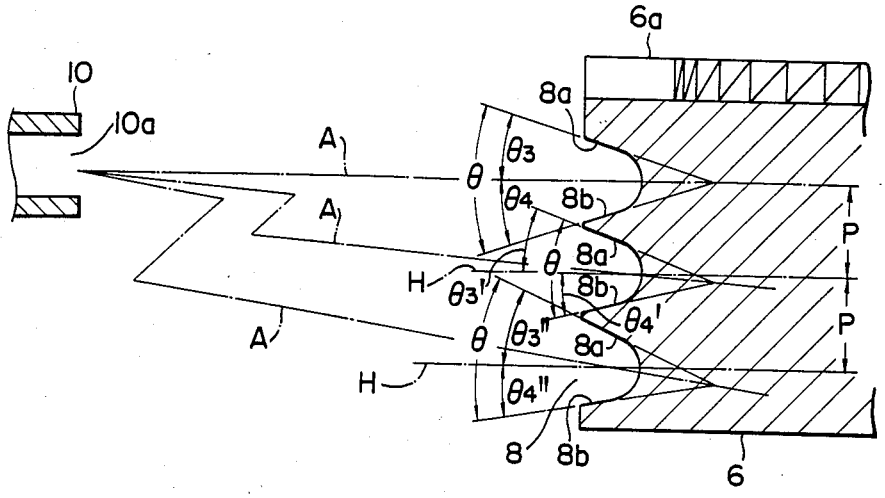
FIG. 3 is an enlarged longitudinal sectional view, showing the principles of a take-up drum of a first embodiment of the present invention.
Figure 4:
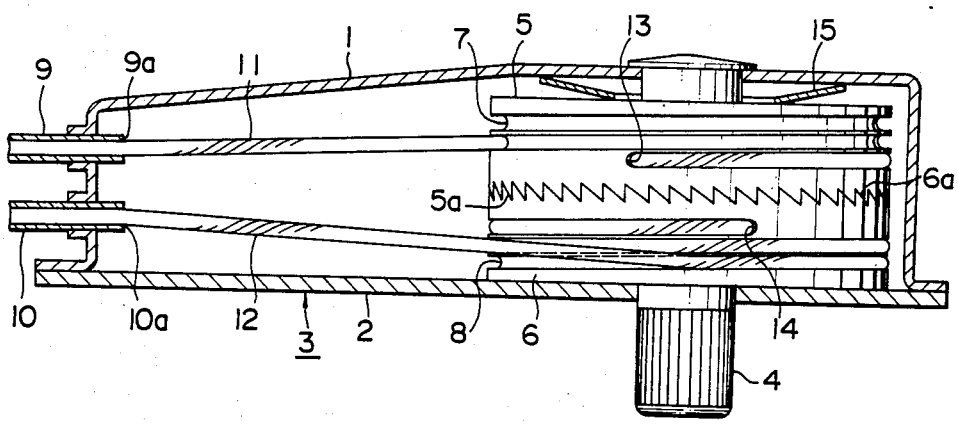
FIG. 4 is a longitudinal sectional view, showing the entire construction of the first embodiment in FIG. 3.

Now, explanation of the first embodiment of the present invention as shown in FIGS. 3 and 4 will be made hereinafter.

Figure 1:
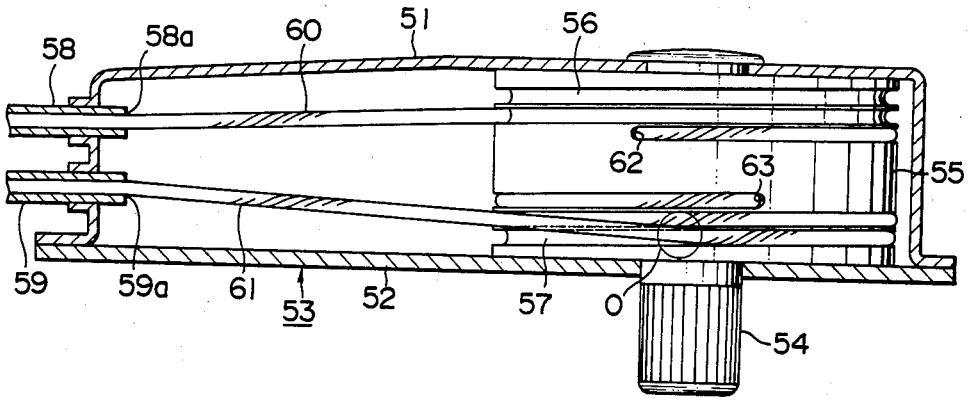
FIG. 1 PRIOR ART
FIG. 1 is a longitudinal sectional view, showing one embodiment of a conventional winding device.
Figure 2:
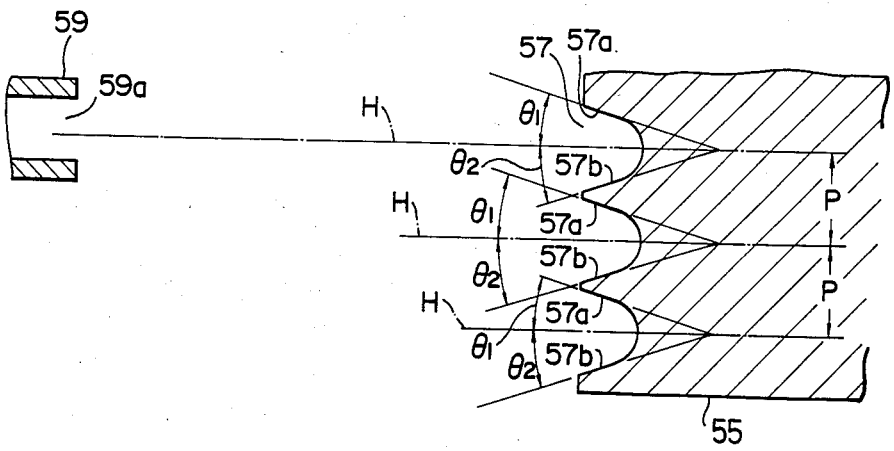
FIG. 2 PRIOR ART
FIG. 2 is an enlarged longitudinal sectional view, showing the principles of a take-up drum as in FIG. 1.

The numerical references 1 and 2 designate a casing and a base plate respectively, and a support 3 is formed by both of them. In this regard, the present invention has the same construction as that of the conventional device as shown in FIG. 1.

A pair of take-up drums 5, 6 of the same diameter are mounted over a rotary shaft 4 extending vertically in the drawing and rotatably pivoted between the casing 1 and the base plate 2.

The first take-up drum 5 is pivotally mounted to rotate relative to the rotary shaft 4, while the second take-up drum 6 is associated with the rotary shaft 4 to rotate together with the rotary shaft 4.

Both take-up drums 5, 6 are coupled with each other by means of gear teeth 5*a*, 6*a* of ratchet type formed on the end surfaces of the drums facing each other. When cables 11, 12 wound round each outer circumference of the take-up drums 5, 6 respectively in opposite directions to each other become slack, the take-up drums 5, 6 can rotate relatively to take up the slack of the cables, for example, by operating a handle (not shown) connected to the rotary shaft 4 or by a spring means (not shown) disposed within the take-up drums. The reference 15 is a leaf spring which is mounted between the casing 1 and the first take-up drum 5 in a state of compression in order to press the first take-up drum 5 onto the second take-up drum 6 for mutual engagement of the ratchet gear teeth 5*a*, 6*a*.

The outer circumferences of the take-up drums 5, 6, are provided with grooves 7, 8 respectively for guiding the cables, said grooves being formed in spiral in the same direction and having a V-shaped or U-shaped cross section.

A pair of guide tubes 9, 10 are firmly attached to one end of the casing 1 spaced vertically in the drawing and substantially in parallel with the base plate 2.

The cables 11, 12 pass through these guide tubes 9, 10 and are drawn from openings 9*a*, 10*a* formed at the ends of the guide tubes 9, 10 respectively facing the take-up drums 5, 6. Then, the cables are wound round the take-up drums 5, 6 along the grooves 7, 8 respectively in opposite directions to each other.

The numerical references 13, 14 designate bores for leading each end of the cables 11, 12 into the inside of the take-up drums 5, 6 respectively and fastening them therein.

As shown in FIG. 3, in this first embodiment, each groove 7, 8 (the following explanation only refers to the case of the groove 8) is formed such that bisectors A of the angles $\theta$ between both side walls 8*a*, 8*b* of the groove are always directed to the opening 10*a*. The angles $\theta_3$, $\theta_3'$, $\theta_3''$ between the side walls 8*a* of the groove 8 and the normal lines H perpendicular to the rotational axis of the take-up drum 6 increase gradually with distance from the opening 10*a*. With the exception of the symetrically oriented upper angle $\theta$ (FIG. 3), the side walls 8*a* are closer than side walls 8*b* to the opening 10*a*.

Accordingly, angles $\theta_4$, $\theta_4'$, $\theta_4''$ between the side walls 8*b* and the normal lines H decrease gradually with distance from the opening 10*a*. Then, $$\theta=\theta_3+\theta_4=\theta_3'+\theta_4'=\theta_3''+\theta_4''$$

$$\theta_3<\theta_3'<\theta_3'',\ \theta_4>\theta_4'>\theta_4''$$

Here, $\theta_3$, $\theta_4$ are angles between each side wall 8*a*, 8*b* respectively and the normal line H of the first pitch, $\theta_3'$, $\theta_4'$ are angles between each side wall 8*a*, 8*b* respectively and the normal line H of the second pitch, and $\theta_3''$, $\theta_4''$ are angles between each side wall 8*a*, 8*b* respectively and the normal line H of the third pitch.

With the above described construction of the first embodiment, there is no possibility that the cables 11, 12 would chafe against the side walls 8*a* of the grooves 7, 8, when they are wound round the take-up drums 5, 6 at a position far from each opening 9*a*, 10*a*. Operation is without causing unusual noise or being worn severely.

Further, there is no need to increase the pitches P of the grooves 7, 8.

Figure 5:
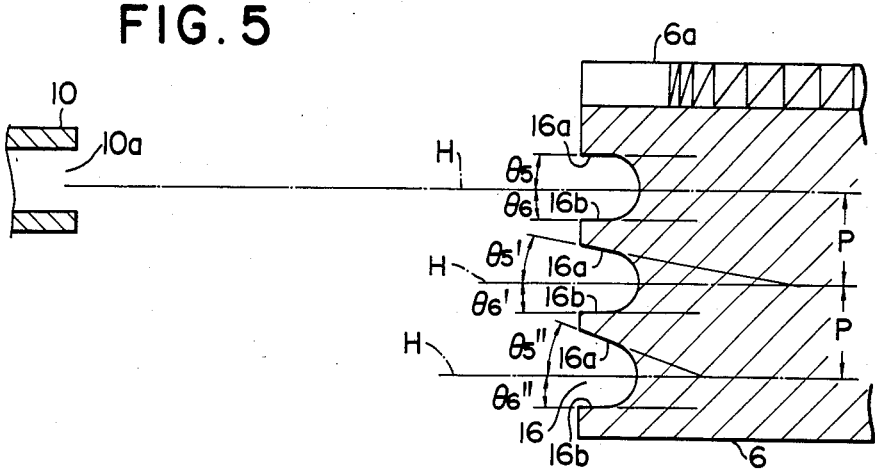
FIG. 5 is also an enlarged longitudinal sectional view, but showing the principles of a take-up drum of a second embodiment of the present invention.

FIG. 5 illustrates the second embodiment of the present invention, in which only angles $\theta_5$, $\theta_5'$, $\theta_5''$ between the side walls 16*a* of the groove 16 and the normal lines H perpendicular to the rotating axis of the take-up drum 6 increase gradually with distance from the opening 10*a*, while angles $\theta_6$, $\theta_6'$, $\theta_6''$ between the side walls 16*b* and the normal lines H are kept constant. Then, $$\theta_5<\theta_5'<\theta_5'',\ \text{and}\ \theta_6=\theta_6'=\theta_6''$$

With the exception of the symetrically oriented groove including angles $\theta_5$, $\theta_6$, the walls 16*a* are closer to the opening 10*a* than the walls 16*b*.

Except this, the construction of the second embodiment is the same as that of the first embodiment.

With this construction of the second embodiment, it is also possible to achieve almost the same effects as with the first embodiment.

Further, in either embodiment of the present invention described above, it is possible to form desired grooves accurately by utilizing a numerically controlled machining center.

Figure 6:
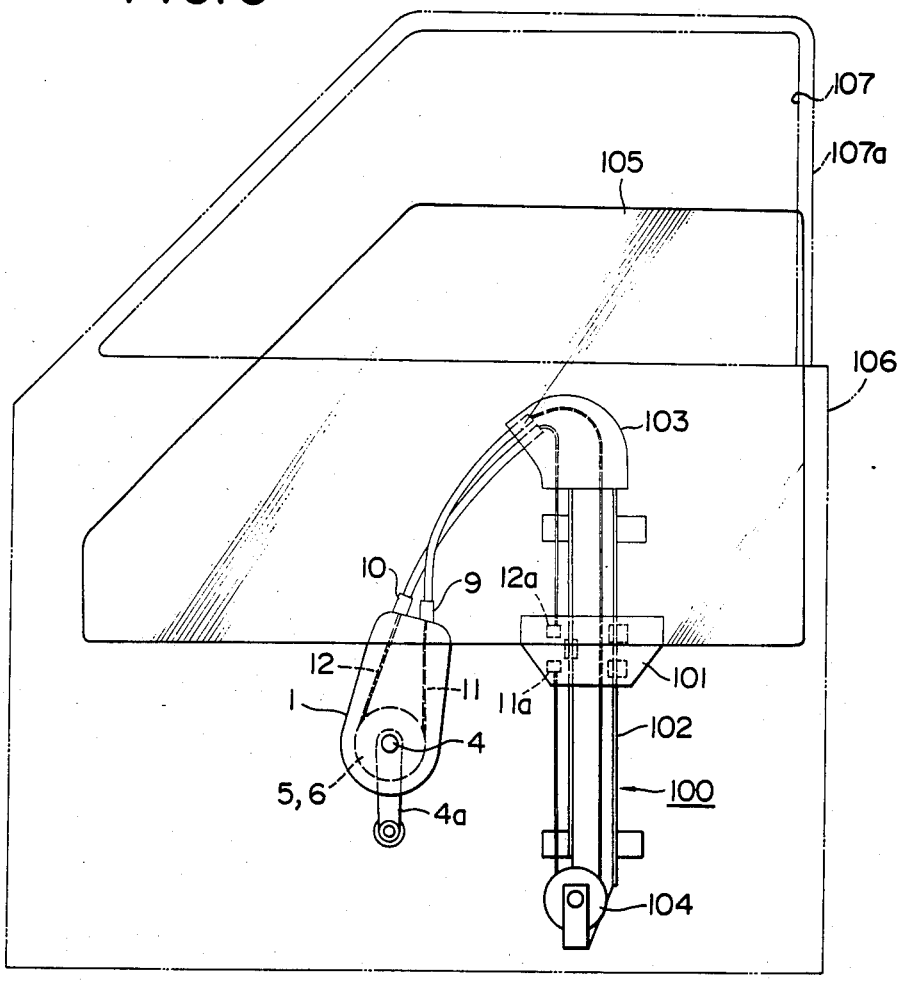
FIG. 6 is a schematic diagram showing a window regulator utilizing the winding device for cables according to the present invention and mounted to an automobile door in use.

In FIG. 6, there is shown a window regulator 100 of the wire driving type utilizing a winding device for cables according to the present invention.

The window regulator 100 comprises a carrier plate 101 firmly attached to the lower end of a window glass 105, a guide rail 102 supporting the carrier plate 101 which is movable vertically along the guide rail 102, a roller 104 fixedly mounted at the lower end of the guide rail 102, and a winding device for cables 1.

The cable 12 which is led upward from the take-up drum 6 through the guide tube 10 and is turned downward at the upper end 103 of the guide rail 102 is fastened at one end to the upper end 12*a* of the carrier plate 101. The other cable 11, which is also led upward from the take-up drum 5 through the guide tube 9 and turned downward at the upper end 103, is guided along the guide rail 102 to its lower end, and then wound round the roller 104 to be directed upward along the guide rail 102 and fastened at one end to the lower end 11*a* of the carrier plate 101. Thus, these cables 11, 12 substantially form a loop through the take-up drums 5,6 and the carrier plate 101.

In use, the window regulator 100 is mounted within the door panel 106, and by operating a handle 4*a* connected to the rotary shaft 4, the take-up drums 5, 6 are rotated in either direction to move the carrier plate 101 upward and downward along the guide rail 102, so that the window glass 105 is moved up and down to close and open the window 107 defined by the window frame 107*a*.

It will be appreciated from the foregoing that the present invention has such advantages that the cables can be wound and/or released smoothly by rotation of the take-up drums without chafing against the side walls of the grooves which may cause unusual noise or the cables to be worn severely, and also there is no need to increase the pitch of the grooves more than that of the conventional device.

I claim:

1. A winding device for cables wherein grooves having first and second side walls and a substantially V-shaped or U-shaped cross-section are formed in the outer circumference of a take-up drum mounted to a support for rotation about an axis, and cables drawn from openings provided in said support are wound round the outer circumference of the take-up drum along said grooves, characterized by that;

angles between said first side walls of said grooves and normal lines perpendicular to said axis of the take-up drum increase gradually with distance of said first walls from the associated openings, the distances of said second walls to said opening being equal or greater than the distances of the associated first walls to said opening.

2. A winding device as set forth in claim 1, in which bisectors of angles between both side walls of the grooves are always oriented toward the openings.

3. A winding device as set forth in claim 1, in which angles between said second side walls of the grooves and the normal lines are equal.

4. A winding device as set forth in any one of claims 1 to 3, in which the take-drum comprises two drum members which are disposed coaxially and symmetrically in mutual engagement with each other by means of gear teeth formed on each mating surface of the drum members, said drum members being relatively rotatable in opposite directions for taking up slack of the cables.

5. A window regulator for automobiles of the wire driving type which is mounted within a door panel to move a window glass for closing and opening a window of an automobile, comprising a guide rail of extended length, a carrier plate firmly attached to a lower end of the window glass and supported on said guide rail to be movable along the guide rail, and a winding device for cables, in which grooves having first and second side walls and a substantially V-shaped or U-shaped cross-section are formed in the outer circumference of a take-up drum mounted to a support for rotation about an axis, cables drawn from openings provided to said support being wound round the outer circumference of the take-up drum along said grooves, and angles between said first side walls of said grooves and normal lines perpendicular to the said rotating axis of the take-up drum increase gradually with distance of said first walls from the associated openings, the distances of said second walls to said opening being equal or greater than the distances of the associated first walls to said opening, said cables being led from the take-up drum to one end of said guide rail, guided along the guide rail and fastened at one end to the carrier plate, thereby forming substantially one loop through the take-up drum, the carrier plate being subject to movement upward and downward along the guide rail by rotation of the take-up drum to open and close the window.

6. A window regulator as claimed in claim 5 wherein said guide rail is vertical.

7. A winding device for cables comprising:

a support including an opening;

a take-up drum mounted to said support for rotation about an axis, grooves having first and second side walls and a substantially V-shaped or U-shaped cross-section being formed in the outer circumference of said take-up drum;

a cable drawn from said opening provided in said support, said cable being wound around the outer circumference of said take-up drum along said grooves, the opening angles of said grooves being equal, bisectors of said angles between both side walls of said grooves being pointed towards said opening wherefrom said cable is drawn, the angle between said bisectors and a normal line perpendicular to said rotational axis increasing gradually with distance of said groove from said opening.

8. A winding device for cables wherein grooves having first and second side walls and a substantially V-shaped or U-shaped cross-section are formed in the outer circumference of a take-up drum mounted to a support for rotation about an axis, and a cable drawn from an opening provided in said support is wound round the outer circumference of the take-up drum along said grooves, characterized in that;

angles between said first side walls of said grooves and normal lines perpendicular to said axis of the take-up drum increase gradually with distance of said first walls from the opening, the distances of said second walls to said opening being equal or greater than the distances of the associated first walls to said opening.

* * * * *